US005500276A

United States Patent [19]

Sawada et al.

[11] Patent Number: 5,500,276

[45] Date of Patent: Mar. 19, 1996

[54] SLIDE FASTENER MADE OF SYNTHETIC RESIN

[75] Inventors: Ryozo Sawada, Uozu; Masanori Hirasawa, Kurobe; Yoshiharu Yamaguchi, Namerikawa; Shigeru Funakawa; Masaru Kanayama, both of Toyama, all of Japan

[73] Assignee: Yoshida Kogyo K.K., Tokyo, Japan

[21] Appl. No.: 264,055

[22] Filed: Jun. 22, 1994

[30] Foreign Application Priority Data

Jul. 9, 1993 [JP] Japan ..... 5-193021

[51] Int. Cl.[6] ..... B32B 23/02

[52] U.S. Cl. ..... 428/192; 428/411.1; 428/483; 425/814; 525/165; 525/444

[58] Field of Search ..... 24/380; 525/165, 525/444; 428/411.1, 195, 483, 192; 425/545, 814

[56] References Cited

U.S. PATENT DOCUMENTS

| | | | |
|---|---|---|---|
| 4,100,656 | 7/1978 | Moertel | 24/205.16 R |
| 4,182,600 | 1/1980 | Moertel | 425/129 R |
| 4,380,098 | 4/1983 | Fukuroi | 24/205.16 R |
| 4,402,115 | 9/1983 | Moertel | 24/205.16 R |
| 4,718,149 | 1/1988 | Tsubokawa | 24/392 |
| 4,922,584 | 5/1990 | Funakawa et al. | 24/381 |

FOREIGN PATENT DOCUMENTS

| | | |
|---|---|---|
| 0003252 | 8/1979 | European Pat. Off. . |
| 0330171 | 2/1988 | European Pat. Off. . |
| 2531622A1 | 2/1976 | Germany . |

OTHER PUBLICATIONS

European Search Report.

*Primary Examiner*—Patrick J. Ryan
*Assistant Examiner*—William A. Krynski
*Attorney, Agent, or Firm*—Finnegan, Henderson, Farabow, Garrett & Dunner

[57] ABSTRACT

A slide fastener of synthetic resin which has regularly spaced elements formed and fixed to the edge of fastener tape by the injection molding of the molten mass of the synthetic resin is disclosed. The fastener tape is formed of polyethylene terephthalate and the elements of slide fastener are made of a polymer alloy of polybutylene terephthalate with polypropylene or polyethylene terephthalate.

8 Claims, No Drawings

SLIDE FASTENER MADE OF SYNTHETIC RESIN

BACKGROUND OF THE INVENTION

1. Field of the Invention

This invention relates to slide fasteners made of synthetic resin having regularly spaced elements formed and fixed to the edges of fastener tapes by the injection molding of a molten mass of the synthetic resin.

2. Description of the Prior Art

Heretofore, in the field of slide fasteners of synthetic resin, the practice of manufacturing slide fasteners pigmented in various colors for the sake of meeting customer's diversified needs has been in vogue.

Generally the injection molding process is utilized for the purpose of promoting the diversification of slide fasteners in color. To be specific, slide fastener chains are manufactured by first dyeing a fabric fastener tape in a desired color, introducing the dyed fastener tape into an injection molding machine, melting resin chips pigmented in a color coordinated with the color of the dyed fastener tape, and injecting the molten resin thereby forming and fixing the elements to the edge of the strip of the fastener tape. Thus, the impartation of one same color to the fastener tape and the elements is effected.

The conventional method described above may deserve to be rated as a means fit for mass production. It is, however, unfit for the recent trend of manufacturing slide fasteners in small lots with diversification in color. This is because each time the color of the fastener tape is changed, the resin chips to be supplied to the injection molding machine must be reformulated to acquire a color conforming to the new color of the fastener tape and the work of changing the color turns out to be a highly complicated and time-consuming operation.

Though an idea of equipping the slide fastener plant with as many injection molding machines as the colors of fastener tape to be preselected for use in the plant is conceivable, this equipment entails huge expense and proves unfit for production of slide fasteners in small lots.

SUMMARY OF THE INVENTION

A primary object of the present invention is to find out materials for a fastener tape and elements of slide fastener which can be dyed equally in any desired color harmoniously and with a fine state of balance so as to fulfill the need to realize the production of slide fasteners in small lots with diversification in color as described above.

Another object of the present invention is to find out materials for a fastener tape and the elements of slide fastener which exhibit good dyeing properties or dye affinity, manifest ample permeability to dye, exhibit high color fastness so as to defy release of dye due to solution by detergents, solvents, chemicals, etc. and to preclude the migration of dye which would otherwise occur under the pressure exerted as in a abrasion test, and enjoy sufficient mechanical strength.

Still another object of the present invention is to provide a slide fastener of synthetic resin which is formed of such materials as mentioned above and is enabled to be piece dyed equally in any color with good dyeing properties and ample color fastness and, after being dyed, maintain sufficient mechanical strength as a fastener so as to fulfill the need to realize manufacture of slide fasteners in small lots with diversification in color as mentioned above.

To accomplish the objects described above, the present invention provides a slide fastener of synthetic resin having regularly spaced elements formed and fixed to the edge of fastener tape by the injection molding of a molten mass of synthetic resin, in which the fastener tape is formed of polyethylene terephthalate and the elements are formed of a polymer alloy of polybutylene terephthalate (hereinafter referred to briefly as "PBT") with polypropylene (hereinafter referred to briefly as "PP") or polyethylene terephthalate (hereinafter referred to briefly as "PET"). In a preferred embodiment of the present invention, the elements are produced by the injection molding of a PBT/PP alloy or a PBT/PET alloy having a weight ratio in the range of 95/5 to 50/50.

DETAILED DESCRIPTION OF THE INVENTION

The present inventors have conceived an idea of fulfilling the need to realize manufacture of slide fasteners in small lots with diversification in color by adopting one and the same synthetic resin as the materials for fastener tape and elements of slide fastener, melting neutral chips (uncolored) of the synthetic resin and injecting the molten resin onto an uncolored fabric fastener tape of the synthetic resin thereby preparing uncolored slide fasteners having elements formed and fixed to the edges of the strips of fastener tape, and piece dyeing as many uncolored slide fasteners as are required on a given occasion.

Even when the fastener tape and the elements of slide fastener are made of one and the same synthetic resin, however, they cannot be equally dyed in one color harmoniously in a fine state of balance. The following reasons may be given for logical explanation of this fault.

(1) Difference in absorption ratio of dye due to difference in elongation ratio adopted in processing resin material The yarn woven to form the fastener tape has been already elongated during the manufacture thereof, whereas the material injected to form the elements of slide fastener has not been elongated. Thus, the yarn and the material for the elements differ in degree of crystallization from each other. In the course of piece dyeing, therefore, the fastener tape and the elements of slide fastener show a difference in dye absorption ratio.

(2) Difference in absorption ratio of dye due to difference in kind and quantity of pigment incorporated in resin material If one and the same resin material is used in the fabrication of the yarn for the fastener tape and the molding of the elements of slide fastener, the pigments used in the yarn and the elements will be different in kind and quantity. As a result, the fastener tape and the elements of slide fastener show a difference in absorption ratio of dye in the course of piece dyeing.

Further, the slide fastener of synthetic resin is desired to be such in quality as to permit permeation therethrough of dye to a depth enough to keep slight frictions and injuries inflicted on the surface of the elements of slide fastener from discernibly affecting the appearance of the elements, prevent the elements from sustaining any noticeable change in size or shape as a result of the dyeing treatment, and ensure the elements fast retention of mechanical strength capable of withstanding the impacts such as in a durability test for the sliding movement of the slider in addition to manifesting the dyeing property in one and the same color mentioned above.

The present inventors, after a diligent study in search of materials appropriate for the slide fastener of synthetic resin, have found that by using PET as the raw material for the fastener tape and PBT/PP alloy or PBT/PET alloy as the raw material for the elements of slide fastener, the fastener tape and the elements can be equally dyed in one and the same color with sufficient dyeing properties and proper color fastness and the produced slide fastener can retain mechanical strength enough for a fastener after undergoing the dyeing treatment. The present invention has been perfected on the basis of this finding.

To be specific, an uncolored slide fastener to be obtained by melting resin chips of a PBT/PP alloy or PBT/PET alloy and then injecting the molten resin onto a fastener tape woven with a PET yarn thereby fixing elements of slide fastener to the edge of the fastener tape is such that when it is piece dyed in a varying color, the fastener tape and the elements of slide fastener can be equally dyed in a color harmoniously in a fine state of balance and they manifest good dyeing properties or dye affinity, permit fully deep permeation of dye therethrough, and enjoy color fastness so high as to defy release of dye due to solution as with chemicals and preclude migration of dye under pressure. Further, the slide fastener according to the present invention hardly suffers the elements thereof to change their size and shape in consequence of a dyeing treatment and permits fast retention of mechanical strength sufficient for a fastener and durability enough to withstand the impact of the friction between the elements and the slider thereof caused by the sliding movement of the slider. The present invention, therefore, amply satisfies the need to manufacture slide fasteners in small lots with diversification in color and enables the slide fasteners of synthetic resin whose fastener tapes and elements of slide fastener are equally dyed in a varying color harmoniously in a fine state of balance to be produced with high operational efficiency at a low cost.

In the slide fastener of synthetic resin according to the present invention, the PBT/PP alloy or PBT/PET alloy is used as the raw material for the elements thereof. The mixing ratio of the components of the alloy in weight ratio is desired to be in the range of 95/5 to 50/50 (PBT=95 to 50% by weight). If the mixing ratio happens to deviate from this range, the color fastness and mechanical strength of the produced slide fastener may possibly be satisfactory to a certain degree. This deviation nevertheless is undesirable because it renders difficult the attainment of the harmony with which the fastener tapes and the elements of slide fastener are dyed equally in one and the same color. Preferably, the mixing ratio of the PBT/PP alloy is in the range of 90/10 to 70/30 (by weight) and that of the PBT/PET alloy in the range of 90/10 to 60/40 (by weight). While the mixing ratio is in this range, the fastener tapes and the elements of slide fastener are equally dyed in one and the same color harmoniously with particularly good dyeing properties and the produced slide fastener enjoys high color fastness and retains ample mechanical strength after the dyeing treatment.

As described above, the slide fastener of synthetic resin according to the present invention can be piece dyed in a varying color with a varying kind of dye. The dyes to be used for the piece dyeing are desired to be disperse dyes. The disperse dyes which can be effectively used herein are varied so widely as to include quinone type disperse dyes, azo type disperse dyes, and anthraquinone type disperse dyes, for example. As generally practiced, these disperse dyes can be used in combination with various dyeing assistants such as leveling agents and fastness enhancers which are currently in popular use in the art. Though various methods are available for the purpose of the dyeing under discussion, the beam dyeing proves particularly desirable in allowing the dyeing to be continuously performed.

Now, the present invention will be described more specifically below with reference to working examples.

EXAMPLE 1

Slide fasteners of synthetic resin were manufactured by injecting PBT/PP (polybutylene terephthalate/polypropylene) alloys having weight ratios of 90/10, 80/20, and 70/30 under the injecting conditions indicated in Table below onto the edges of fastener tapes woven with a polyethylene terephthalate (PET) yarn thereby fixing elements of slide fastener to the fastener tapes.

EXAMPLE 2

Slide fasteners of synthetic resin were manufactured by following the procedure of Example 1 while using PBT/PET alloys having weight ratios of 90/10, 80/20, 70/30, and 60/40 as the raw materials for elements of slide fastener instead.

Comparative Example 1

A slide fastener of synthetic resin was manufactured by following the procedure of Example 1 while using polyamide (nylon) as the raw material for elements of slide fastener instead.

Comparative Example 2

A slide fastener of synthetic resin was manufactured by following the procedure of Example 1 while using polyacetal as the raw material for elements of slide fastener instead.

Comparative Example 3

A slide fastener of synthetic resin was manufactured by following the procedure of Example 1 while using polybutylene terephthalate (PBT) alone as the raw material for elements of slide fastener instead.

Comparative Example 4

A slide fastener of synthetic resin was manufactured by following the procedure of Example 1 while using polyethylene terephthalate (PET) alone as the raw material for elements of slide fastener instead.

Experiment:

The slide fasteners of synthetic resin manufactured in Examples 1 and 2 and Comparative Examples 1 to 4 were beam dyed in a dye bath containing a quinone type disperse dye, and a fatty acid ester of a polyoxyalkylene type nonionic active agent and a sulfuric ester type anionic active agent as disperse leveling agents under the conditions of 130° C. and 30 minutes. The fastener tapes and the elements of the dyed slide fasteners of synthetic resin were visually rated for equality of coloration and tested for fastness to withstand dry cleaning [Japanese Industrial Standard (JIS) L-0860], fastness to resist sublimation during storage (JIS L-0879), and fastness to resist rubbing (JIS L-0849) as follows. These three Japanese Industrial Standards, reprinted in the English language, are hereby incorporated by reference. The results are shown in Table.

Color fastness to withstand dry cleaning:

A test piece was prepared by sewing a piece of white cloth on one side of a dyed slide fastener of synthetic resin. A test solution was prepared by solving 5 g of di-2-ethylhexyl sodium sulfosuccinate and 5 g of polyoxyethylene nonylphenyl ether in 1 liter of perchloroethylene, then adding 1 ml of water to the resultant solution, and thoroughly stirring the produced mixture. In a test vial of a test washing machine, 100 ml of the test solution prepared as above and 20 stainless steel balls were put, the test solution was heated to 40°±2° C., and the test piece was put in the test solution. The test vial was then attached to the test washing machine and the test washing machine was operated at the temperature mentioned above for 30 minutes. After the cleaning is completed, the test piece was extracted from the test vial, rinsed with 100 ml of perchloroethylene, and dried at 60° to 65° C. The test piece was compared with a discoloration-fading gray scale and the white cloth with a staining gray scale to determine respectively the degree of discoloration-fading and the degree of staining and rate the color fastness.

Color fastness to resist sublimation during storage:

The test piece prepared as above was inserted closely between the heating plates of a testing machine, compressed with a pressure of about 4±1 kPa, and kept at a temperature of 150°±2° C. for 30 seconds. After the heat treatment was completed, the test piece was compared with a discoloration-fading gray scale and the white cloth with a staining gray scale to determine respectively the degree of discoloration-fading and the degree of staining and rate the color fastness.

Color fastness to resist rubbing:

The leading end of a rubbing piece was covered with a piece of white cotton cloth for rubbing which had been left standing under normal conditions for four hours or more. On the test piece fixed on a waterproof abrasive paper of a test piece stand, the rubbing piece was reciprocated ten times over a distance of 10 cm over a period of 10 seconds to rub the test piece. Then, the white cotton cloth for rubbing was compared with a staining gray scale to determine the degree of coloration due to the friction and rate the color fastness.

In the slide fasteners of synthetic resin manufactured severally in Examples 1 and 2, identical results were obtained for all the polymer alloys using components in varying weight ratios mentioned above. In Table, therefore, these slide fasteners are collectively represented simply as Examples 1 and 2 without indicating the weight ratios of components.

It is clearly noted from Table that the fastener tapes and the elements in the slide fasteners of synthetic resin obtained in the comparative examples were not dyed equally in one color, whereas the fastener tapes and the elements in the slide fasteners of synthetic resin obtained in Examples 1 and 2 in accordance with the present invention were equally dyed in one color in an ideal state of harmony and the dyed slide fasteners consequently obtained were found to excel in color fastness to withstand dry cleaning, color fastness to resist sublimation during storage, and color fastness to endure friction.

When the slide fasteners of synthetic resin manufactured in Examples 1 and 2, after being dyed, were tested for durability to withstand the friction due to the sliding movement of a slider and for strength, they showed sufficient durability to resist the friction due to the sliding movement of the slider and ample strength capable of even enduring lateral torsion.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by foregoing description and all changes which come within the meaning and range of equivalency of the claims are, therefore, intended to be embraced therein.

TABLE

| | | | Conditions of injection | | Evaluation of dyeing characteristics of fastener tape and elements | | | |
|---|---|---|---|---|---|---|---|---|
| No. | Material for tape | Material for elements of slide fastener | Injection temperature (°C.) | Injection pressure (kg/cm$^2$) | Rating of equality of coloration of tape and elements by visual examination | Fastness to withstand dry cleaning (JIS L-0860) | Fastness to resist sublimation during storage (JIS L-0879) | Fastness to endure friction (JIS L-0849) |
| Example 1 | PET | PBT/PP alloy | 275 | 640 | ○ | (grade 4) | (grade 4) | (grade 4) |
| Example 2 | | PBT/PET alloy | 250 | 640 | ○ | (grade 4) | (grade 4) | (grade 4) |
| Comparative Example 1 | | Polyamide (nylon) | 240 | 560 | X | (grade 3–4) | (grade 4) | (grade 4) |
| Comparative Example 2 | | Polyacetal | 200 | 960 | X | (grade 3–4) | (grade 3–4) | (grade 4) |
| Comparative Example 3 | | PBT | 280 | 640 | Δ–X | (grade 4) | (grade 4) | (grade 4) |
| Comparative Example 4 | | PET | 295 | 720 | Δ–X | (grade 4) | (grade 3–4) | (grade 3–4) |

Scale of rating
○: Good
Δ: Rather poor
X: Bad

What is claimed is:

1. In an uncolored slide fastener of synthetic resin having regularly spaced elements formed and fixed to an edge of fastener tape by an injection molding of a molten mass of synthetic resin, the improvement comprising the fastener tape formed of polyethylene terephthalate and the elements formed of a polymer alloy of polybutylene terephthalate with polypropylene or polyethylene terephthalate.

2. An uncolored slide fastener of synthetic resin according to claim 1, wherein said elements of uncolored slide fastener are formed of a polybutylene terephthalate/polypropylene alloy having a weight ratio in the range of 995/5 to 50/50.

3. An uncolored slide fastener of synthetic resin according to claim 1, wherein said elements of uncolored slide fastener are formed of a polybutylene terephtbalate/polypropylene alloy having a weight ratio in the range of 90/10 to 70/30.

4. An uncolored slide fastener of synthetic resin according to claim 1, wherein said elements of uncolored slide fastener are formed of a polybutylene terephthalate/polyethylene terephthalate alloy having a weight ratio in the range of 95/5 to 50/50.

5. An uncolored slide fastener of synthetic resin according to claim 1, wherein said elements of uncolored slide fastener are formed of a polybutylene terephthalate/polyethylene terephthalate alloy having a weight ratio in the range of 90/10 to 60/40.

6. An uncolored slide fastener of synthetic resin according to claim 1, wherein said fastener tape and elements of the uncolored slide fastener are dyed in one and the same color by a beam dyeing method.

7. An uncolored slide fastener of synthetic resin according to claim 1, wherein said fastener tape and elements of the uncolored slide fastener are dyed in one and the same color in a dye bath containing a disperse dye.

8. An uncolored slide fastener of synthetic resin according to claim 1, wherein said disperse dye is selected from the group consisting of quinone, azo, and anthraquinone disperse dyes.

* * * * *

UNITED STATES PATENT AND TRADEMARK OFFICE

CERTIFICATE OF CORRECTION

PATENT NO. : 5,500,276

DATED : March 19, 1996

INVENTOR(S) : Ryozo Sawada et al.

It is certified that error appears in the above-indentified patent and that said Letters Patent is hereby corrected as shown below:

Claim 3, column 7, line 2, "terephtbalate/polypropylene" should read --terephthalate/polypropylene--.

Signed and Sealed this

Nineteenth Day of November, 1996

*Attest:*

*Attesting Officer*

BRUCE LEHMAN

*Commissioner of Patents and Trademarks*